United States Patent [19]

Matechuk

[11] 4,067,294

[45] Jan. 10, 1978

[54] DRY WALL ADHESIVE TAPE APPLICATOR

[76] Inventor: Edward Matechuk, 1061 Thomas Ave., Coquitlam, B. C., Canada, V3K 2K5

[21] Appl. No.: 738,644

[22] Filed: Nov. 4, 1976

[51] Int. Cl. ..... B05c 3/18

[52] U.S. Cl. ..... 118/415

[58] Field of Search ..... 118/413, 415, 412, 414, 118/43

[56] References Cited

U.S. PATENT DOCUMENTS

| | | | |
|---|---|---|---|
| 196,892 | 11/1977 | Green | 118/413 |
| 1,202,664 | 10/1916 | Brownson | 118/43 |
| 1,264,308 | 4/1918 | Kux | 118/43 |
| 2,177,727 | 10/1939 | Krakaur | 118/43 |
| 2,308,464 | 1/1943 | Gautier | 118/43 UX |
| 3,199,490 | 8/1965 | Karlik | 118/43 |
| 3,513,809 | 5/1970 | Abbott et al. | 118/415 |

*Primary Examiner*—Wm. Carter Reynolds

*Attorney, Agent, or Firm*—Carver and Company

[57] ABSTRACT

Tape and adhesive dispenser having adhesive-containing hopper with tape inlet and outlet openings adjacent lower wall of the hopper. Roll of tape is supported so that run of tape passes between openings and along upper surface of lower wall and collects adhesive thereon. Outfeed platform extends outwardly from outlet opening and has spaced edge guide means to restrain opposite margins of tape as tape passes along platform. Tape restrainer is mounted for rotation in direction of feed of tape above platform so that a lowermost portion thereof is spaced closely from the platform to permit tape to pass between platform and restrainer. The restrainer has clearance so that minimal adhesive is removed from tape as it passes beneath the restrainer. The restrainer is cylinder carrying pair of thin spaced discs, positioned adjacent central portion of tape to provide restraint at tape center. Two embodiments of self-threading means permit easy threading of tape.

12 Claims, 9 Drawing Figures

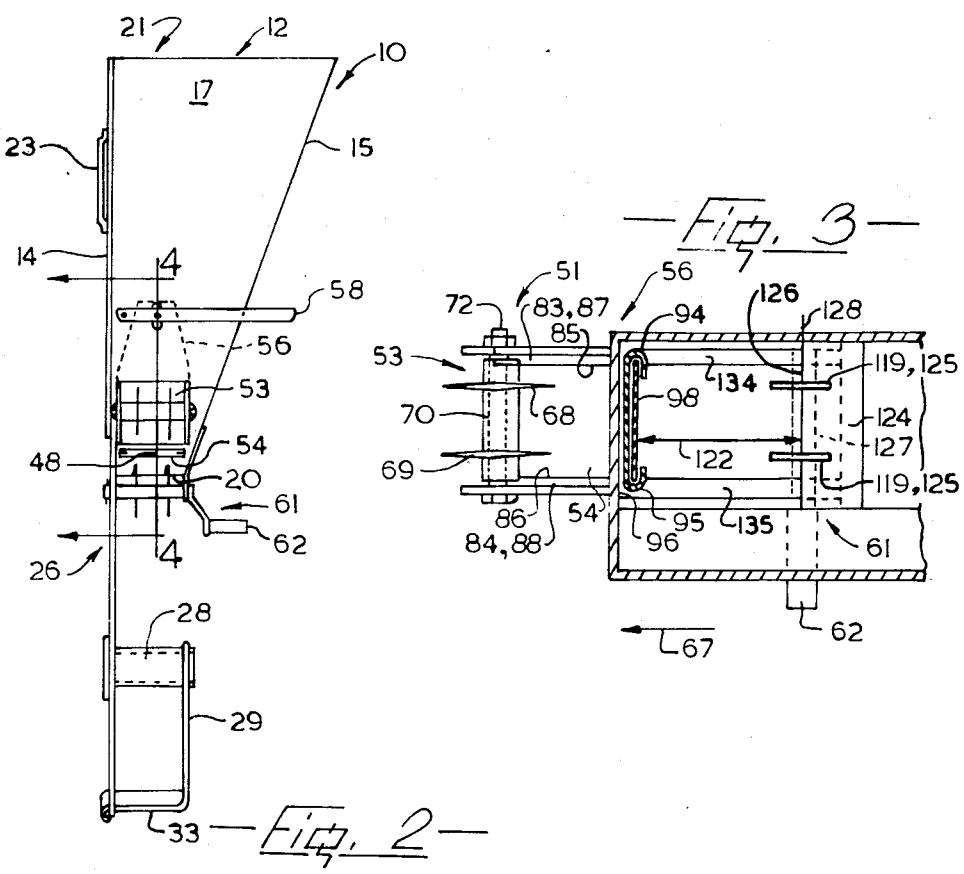
FIG. 3
FIG. 2
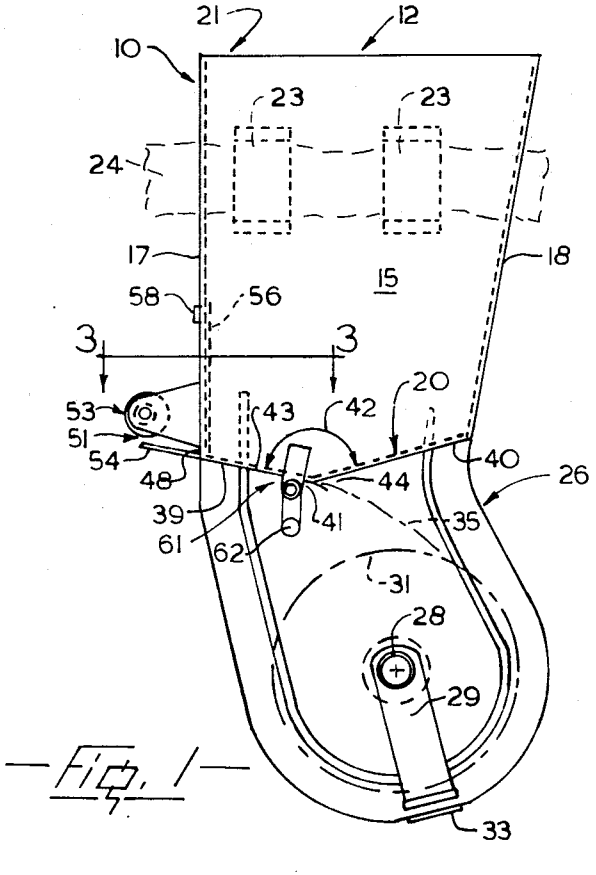
FIG. 1

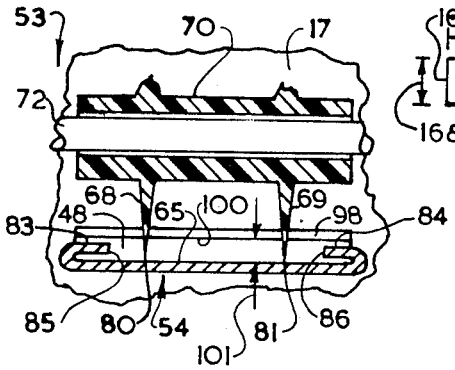
— Fig. 6 —
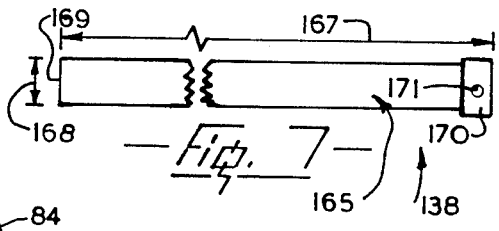
— Fig. 7 —
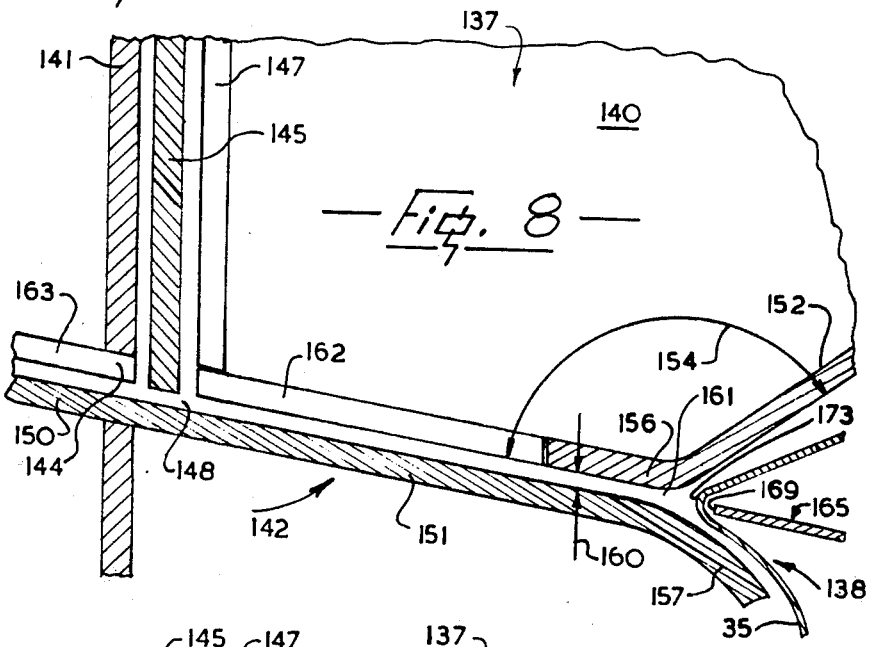
— Fig. 8 —
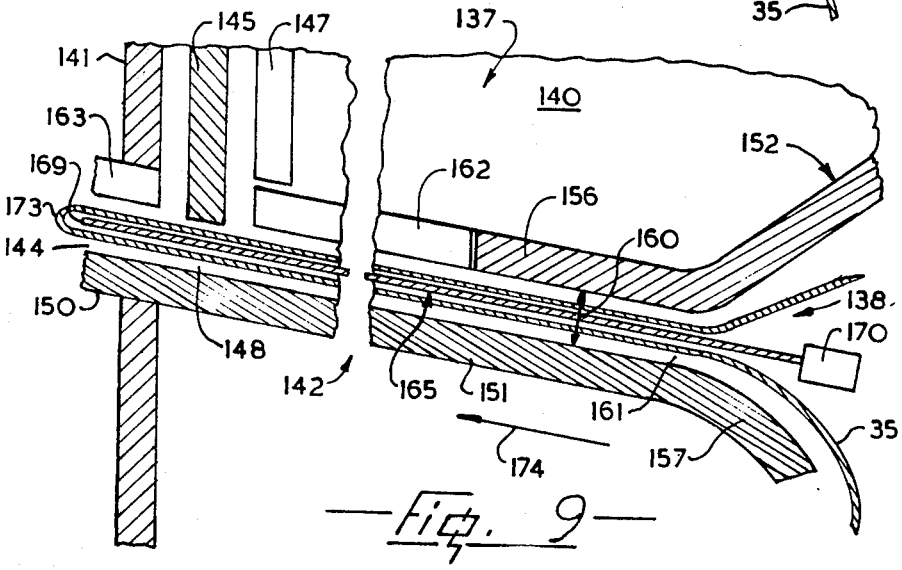
— Fig. 9 —

DRY WALL ADHESIVE TAPE APPLICATOR

BACKGROUND OF THE INVENTION

1. Field of the Invention

The invention relates to a dispenser particularly adapted for, but not limited to, dispensing tape and adhesive for taping joints between adjacent sheets of dry wall or wall board and like materials.

2. Prior Art

Dry wall tape and adhesive dispensers have been known for many years and commonly include a hopper to contain adhesive and carry a roll of tape which is exposed to adhesive as it unwinds, the tape leaving the dispenser covered with a thin layer of adhesive. With some dispensers, difficulty can be experienced in threading the tape initially into the dispenser, particularly when the hopper contains adhesive. When the adhesive coated tape is drawn from the dispenser, commonly the tape passes through guides which sometimes scrape some of the adhesive from the tape, which results in uneven application of adhesive on the wall board. Many of these tape dispensers are bulky and thus cannot be used easily in confined spaces such as in closets etc. Also some dispensers require setting on the floor or a table, and thus when the adhesive coated tape is dispensed it has to be carried to the location where it is to be applied, with a possibility of some of the adhesive dropping off the tape, or the tape tearing under the weight of adhesive which can tear moisture weakened paper. Alternatively, if the dispenser is light enough to be carried, one hand is required for carrying it and this can make application of tape difficult.

SUMMARY OF THE INVENTION

The invention reduces the difficulties and disadvantages of the prior art by providing a compact portable tape and adhesive dispenser which is hung from a belt around an operator's waist, allowing both hands of the operator to be free, thus facilitating application of tape. Furthermore the dispenser has a restrainer which restrains the tape essentially without scraping adhesive from the tape, and it also has self-threading means which facilitates threading of tape even when the dispenser contains adhesive. The dispenser also has control means to control application of adhesive to the tape, thus permitting adjustment of the amount of adhesive applied to the tape.

A dispenser according to the invention has a hopper to contain adhesive, the hopper having tape inlet and outlet openings generally adjacent a lower wall of the hopper. Roll supporting means carry a roll of tape so that a run of tape is adapted to pass between the openings and along an upper surface of the lower wall so as to be exposed to adhesive in the hopper. Thus adhesive is carried on the tape as the tape passes outwards from the hopper through the outlet openings. The dispenser is further characterized by an outfeed guide means including an outfeed platform extending outwards from the outfeed opening and having spaced edge guide means to guide opposite edges of the tape as the tape passes along the platform. A tape restrainer is mounted for rotation in direction of feed of the tape above the platform so that a lowermost portion thereof is spaced closely from the platform to permit the tape to pass between the platform and the restrainer, the restrainer having clearance so that adhesive is retained on the tape as it passes beneath the tape restrainer.

A detailed disclosure following, related to drawings, described a preferred embodiment of the invention, which is capable of expression in structure other than that particularly described and illustrated.

DESCRIPTION OF THE DRAWINGS

FIG. 1 is a simplified side elevation of a tape dispenser according to the invention, some details being omitted, FIG. 2 is a simplified end elevation of the tape dispenser of FIG. 1, FIG. 3 is a simplified fragmented section at an enlarged scale of portions of the dispenser as seen from line 3—3 of FIG. 1, FIG. 6 is a simplified fragmented section on line 6—6 of FIG. 4, some portions being omitted, FIG. 7 is a plan view of a finger member used in an alternative self-threading means, FIG. 8 is a simplified fragmented section through a portion of an alternative dispenser showing the alternative self-threading means of FIG. 7 prior to threading the tape, FIG. 9 is fragmented section similar to FIG. 8 at an enlarged scale during threading of the tape.

DETAILED DISCLOSURE

FIGS. 1 AND 2

Figure 4:
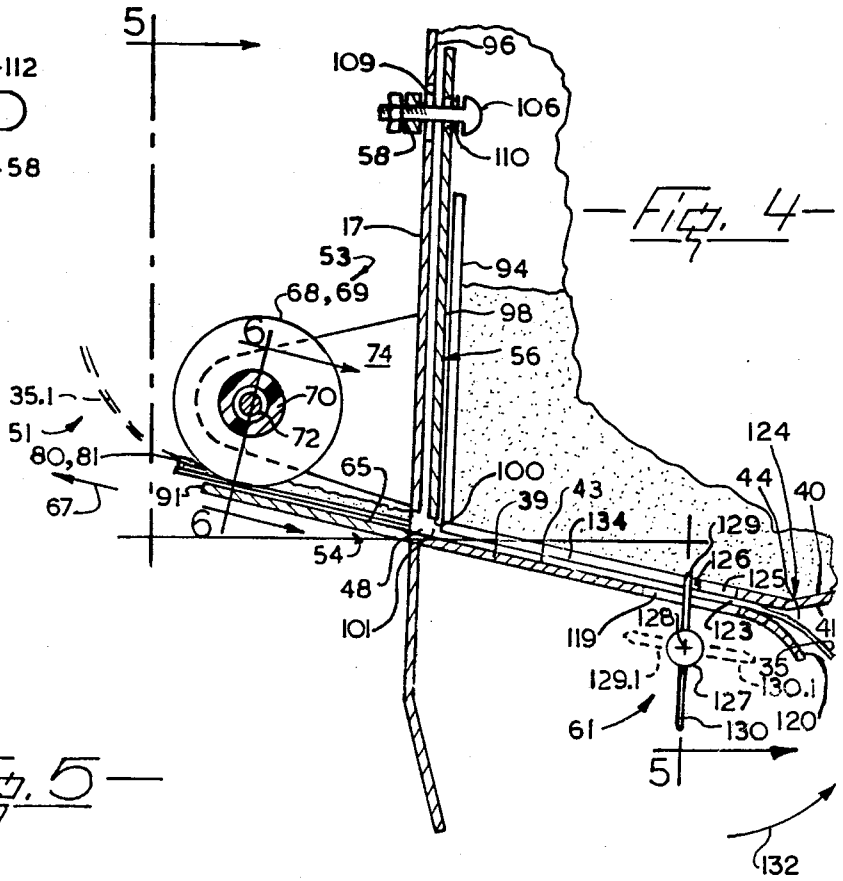
FIG. 4 is a simplified fragmented section of portions of the dispenser as seen from line 4—4 of FIG. 2.

A tape and adhesive dispenser 10 according to the invention has a hopper 12 defined by spaced opposed inner and outer side walls 14 and 15, and spaced opposed end walls 17 and 18 and a lower wall 20. The hopper has an open upper end 21 for loading with adhesive, commonly a sloppy, plaster-like mixture called in the trade "mud", which is commonly used to join and seal adjacent wall boards as used on interior walls. The inner side wall 14 carries on an outer face thereof a pair of belt attachment means 23 for accepting a supporting belt 24, shown in broken outline, so that the device can be hung adjacent the waist of an operator with the inner side wall 14 thereof against the operator's thigh.

The side wall 14 is a portion of a plate 26, a lower portion of which is disposed below the hopper and carries a roll support 28 extending outwards therefrom and a roll keeper 29. A roll of common dry wall tape 31 is carried on the support 28 and held thereon by the keeper 29 which is releasably attached thereto, a lower end 33 of the keeper being held in a complementary slot adjacent a lower edge of the plate 26. The support 28 is preferably fixed relative to the plate 26 so that as a run of tape 35 is unrolled from the roll an inner surface of the roll drags on the support 28 thus reducing a tendency of the roll to unwind prematurely. The keeper 29 simultaneously prevents the roll sliding off the support 28 and also eliminates excessive premature unwinding of the roll.

The lower wall 20 of the hopper has first and second portions 39 and 40 which are inclined to each other at a obtuse angle 42 so as to define a shallow vee therebetween at an apex 41. The first portion 39 of the lower wall 20 has an upper surface 43 which is spaced from the second portion 40 to define a relatively narrow first opening 44 therebetween. A lower edge of the end wall 17 is spaced from the upper surface 43 of the portion 39 so as to define a second opening 48 therebetween. The openings 44 and 48 serve as tape inlet and outlet openings respectively which are generally adjacent the lower wall 20 of the hopper so that the run of tape 35 is adapted to extend between the openings and along the upper surface 43 of the lower wall so as to be exposed to adhesive in the hopper. Thus, as will be described, adhesive in the hopper is carried on the tape as the tape passes outwards from the hopper through the outlet opening.

The invention is characterized by an outfeed guide means 51 adjacent the outlet opening 48, which means includes a tape restrainer 53 and an outfeed platform 54. A flow control gate means 56 controlled by a lever 58 cooperates with the outlet opening 48 and the upper surface 43 of the wall 20 so as to control the thickness of adhesive carried on the tape as it leaves the outlet openings.

The invention is further characterized by a self-threading means 61 which cooperates with the tape to feed a free end of the tape through the outlet opening after a new roll of tape has been fitted. The self-threading means has a handle 62 which is rotated only during tape threading and then set in a particular position to permit free passage of the tape. The means 51, 56 and 61 are described with reference to FIGS. 3 through 6.

FIGS. 3 THROUGH 6

The outfeed platform 54 extends outwardly from the outlet opening and the tape restrainer 53 is mounted for rotation in direction of feed of the tape, shown as an arrow 67. The tape restrainer includes a pair of relatively thin, parallel spaced discs 68 and 69 carried on a cylinder 70 journalled for rotation on a spindle 72 carried in a pair of spaced brackets 74 and 75 extending from the end walls 17. The discs are thus mounted for rotation above the platform 54 within planes aligned with the direction of feed of the tape along the platform, so as to rotate with the tape. Lowermost portions of rims 80 and 81 of the discs 68 and 69 respectively are spaced from an upper surface 65 of the platform to permit the tape to pass between the rims and the platform whilst maintaining the tape generally adjacent to the platform.

The discs 68 and 69 are relatively thin, for example the rims thereof should be no greater than 0.5 mms. so as to disturb minimally adhesive carried on the tape. Because the disc are thin, adequate clearance is provided between the discs to prevent essentially accumulation of adhesive between the discs. If the rims are thicker than 0.5 mms. for example 5.0 mms., excessive adhesive would be displaced from the tape which would likely result in inadequate adhesive coverage when the tape is applied to the wall board. Furthermore clearance between the discs would be reduced which would increase the likelihood of adhesive accumulating between the discs. The discs are made suitably of a tough plastic moulded integrally with the cylinder 70 as a rigid assembly to rotate on the spindle 72. It is expected that, due to the abrasive nature of the adhesive, replacement of discs and cylinder would be necessary after some time of operation. Alternatively, the discs can be journalled directly on the spindle 72 with spacers to separate them, but this would likely result in more rapid wear of discs requiring more frequent replacement. Thus in summary, the tape restrainer 53 is mounted above the platform so that a lowermost portion thereof is spaced closely from the upper surface 65 of the platform to permit the tape to pass between the platform and the restrainer. The restrainer must have clearance adjacent to an area of contact with the tape so that adhesive is retained on the tape as it passes beneath the tape restrainer.

The platform 54 has upwardly and inwardly turned marginal portions 83 and 84 which form overhanging strips extending substantially along the opposite edges of the platform so that respective adjacent margins of the tape are sandwiched between the upper surface 65 of the platform and the respective strip. The overhanging strips thus provide spaced edge guide means 87 and 88 to guide opposite edges of the tape as the tape passes along the platform. The strips have inner edges 85 and 86 spaced apart at outer ends thereof to provide clearance therebetween, and the two discs are spaced inwardly of the edges 85 and 86 within the clearance so as to provide restraint adjacent the central portions of the tape. Thus the tape is restrained at the margins thereof by the edge guide means and adjacent the central portions by the spaced discs so that when the tape is to be torn off by the operator, it is moved to a broken outline position 35.1 in FIG. 4 and, normally it will not become disengaged from the outfeed guide means.

Note that the discs are positioned relative to an outer edge 91 of the platform 54 so that the lowermost portions 80 and 81 of the rims are spaced closely to and above the edge 91. If the platform 54 were to be made shorter than as shown, that is, if the edge 91 were moved inwardly relative to the position of the discs so that the edge 91 becomes positioned between the portions 80 and 81 and the end wall 17, there would be insufficient support for the tape bearing the adhesive which would possibly result in loss of adhesive from the tape. If the edge 91 is positioned excessively forwardly of the lowermost portions 80 and 81, this would be less of a disadvantage, but there may be difficulty in locating and separating from the platform the free end of the tape and losses in time coupled with excessive waste of tape might result.

Referring to FIGS. 3, 4 and 6 the flow control gate means 56 includes a pair of spaced, parallel gate guides 94 and 95 extending generally vertically adjacent an inside face 96 of the hopper i.e. on a side of the end wall 17 remote from the tape restrainer 53. A gate member 98 is slideably mounted within the gate guides for movement generally normal to the upper surface 65 of the platform 54. The gate member has a straight lower edge 100 which is generally parallel to the upper surface 65 and defines a gap 101 therebetween except when the gate is closed and the edge 100 contacts the surface 65. The gate can thus close the outlet opening 48 when required but when in operation it is used as a flow control means to control depth of adhesive carried on the tape as it leaves the outlet opening 48.

Figure 5:
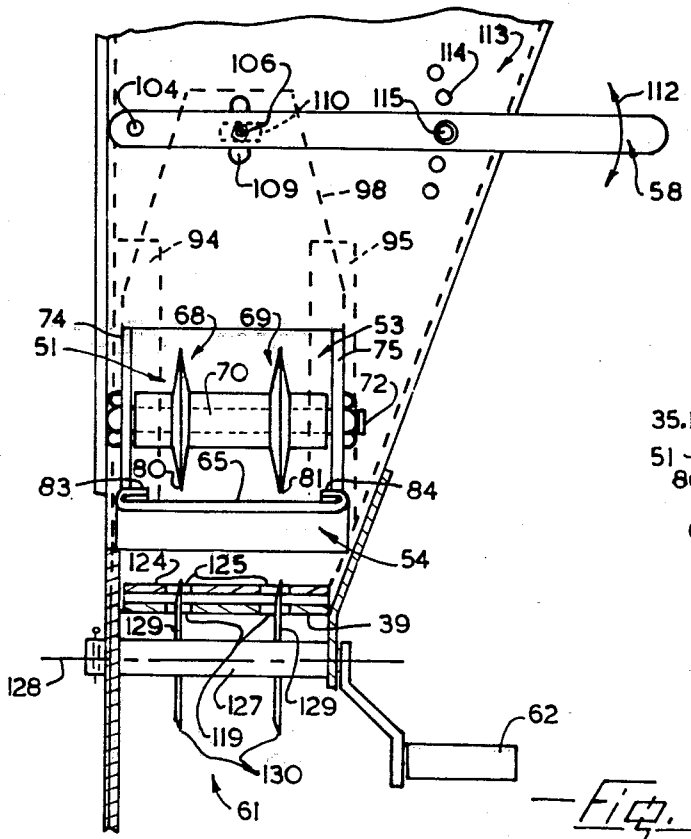
FIG. 5 is a simplified fragmented section of portions of the dispenser as seen from line 5—5 of FIG. 4, portions of tape being omitted.

In FIG. 5, the lever 58 has an inner end 104 hinged to the hopper so as to rotatable relative to the hopper. A short bolt or pin 106 extends inwardly from the lever and passes through an arcuate slot 109 in the hopper end wall 17, and has an inner portion carried in a elongated transverse slot 110 in the gate member. It can be seen that rotation of the lever 58 about the end 104 according to an arrow 112 moves the gate member 98 in the guides and varies the gap 101 which varies the amount of adhesive carried on the tape as it leaves the outlet opening 48. A locking means 113 to hold the gate in the desired position to maintain the desired gap 101 includes a row of dimples 114 pressed in the end wall 17 which cooperates with an opening 115 in the lever 58. The lever is thus relatively tightly restrained to restrict swinging thereof unless initiated by the operator, and thus resetting should not be required. Alternative locking means can be devised.

The self-threading means 61 is characterized by the portion 39 of the lower wall 20 of the hopper having a pair of parallel clearance slots 119 aligned in direction of feed of the tape, that is in direction of the arrow 67. A shield or lip 124 extends from a lower portion of the hopper generally adjacent to the inlet opening 44 and above the pair of clearance slots 119. The shield 124 extends forwardly from the portion 40 to a forward edge 126 and is generally parallel to and is spaced upwardly from the portion 39 to define a clearance space 123. The space 123 is sufficiently wide to admit the tape between the shield or lip 124 and the portion 39 of the lower wall, and yet sufficiently narrow to reduce or prevent flow of adhesive between the shield member and the lower wall. The edge 126 of the shield 124 has a pair of spaced clearance slots 125 extending rearwardly therefrom and positioned generally above and aligned with the clearance slots 119, and similarly aligned with the direction of the arrow 67. A rear portion 120 of the first portion 39 is curved downwardly as shown to form a funnel-like entrance to the inlet opening 44 to facilitate insertion of the tape.

The means 61 further includes a core member 127 journalled for rotation about an axis 128 disposed transversely to the direction of feed of tape and below the lower wall 20. The member 127 has a periphery having a pair of diametrically opposed feed spikes 129 and 130 extending radially therefrom so as to extend from at least one portion of the periphery, a remaining portion of the periphery being relatively smooth without spikes. The handle 62 is secured to the member 127 so that the rotation of the handle 62 in direction of an arrow 132 rotates the member so that the spikes swing across the space 123, passing simultaneously through both slot pairs 119 and 125 and sweeping towards the outlet opening. The spikes and core member are positioned so that when the self-threading means is actuated the spikes project through the respective clearance slots to engage and penetrate a portion of the tape extending through the space 123, ie between the shield 124 and the portion 39 of the lower wall 20, portions of the shield 124 essentially preventing the tape from being pushed upwards by the spikes and away from the spikes. As the spikes swing forwardly through the space 123, they engage and feed the tape in direction of the arrow 67. When the core member is rotated through about 90 degrees the spikes become disengaged from the tape and assume disengaged positions 129.1 and 130.1, and a portion of the periphery of the member 127 without spikes is then positioned adjacent the slots. Thus the spikes are retracted through the clearance slots to permit free passage of the tape which can then be pulled by the operator with no restriction from the self-threading means. The self-threading means is thus effectively retractable when no longer needed. Internal edge guides 134 and 135 extend between the edge 126 and the outlet opening 48 along opposite edges of the upper surface 43 and are aligned with the edge guide means 87 and 88 on the platform to retain and guide edges of the tape as the tape traverses the hopper.

The edge 126 is spaced from the wall 17 of the hopper by a gap 122 which is suitably about 2 to 3 inches depending on the height of the hopper 12. This size of the gap 122 is relatively important as it determines the area of tape exposed to hydraulic head of adhesive in the hopper. If the gap 122 is excessive, when the tape is pulled from the dispenser there will likely be considerable drag resulting from friction between the tape and the upper surface 43 of the wall 20 due to the hydraulic pressure. This may result in tearing of the tape if very sloppy adhesive is used because hydraulic pressure on the exposed portion of tape will increase and the tape is likely to become wetter, which increases tendency of tearing. Thus for a hopper 12 having a height of about ten inches it is recommended that the gap 122 is no greater than about 3 inches. If the gap is too small eg. less than 1 inch, if the tape is fed excessively quickly it may not pick up the adhesive completely. The internal edge guides 134 and 135 at the bottom of the hopper should permit adhesive to coat the margins of the tape held within the guides.

Thus, the free end of the run of tape 35 can be inserted in the inlet opening 44 and threaded inwards a short distance until it passes between the pairs of clearance slots 119 and 125. The handle 62 is then rotated and the feed spikes intermittently engage the tape to feed it through the space 123 to enter the gap 122. The curl of the tape and internal edge guides direct the tape to the outlet opening 48 and to pass therethrough and along the platform 54 under the discs 68 and 69. When the outer end of the run of tape extends clear of the discs, the handle 62 is positioned so that the spikes are retracted from the slots to permit free movement of the tape through the means 61 when pulled by the outer end. It can be seen that the core member and the spikes serve as feed means mounted below the lower wall of the hopper and positioned so as to project through clearance openings in the lower wall to engage the tape when in an extended position for feeding the tape, and to be clear of the tape when in a retracted position to permit the tape to be pulled freely from the dispenser. Other feed means can be substituted in which a spiked member having a plurality of spikes is disposed so that the spikes project through the clearance slots in the lower wall in the extended position. For example, an alternative spiked means includes an endless belt having some portion of its periphery provided with outwardly extending spikes, with other portions of the belt without spikes. An alternative self-threading means is described with reference to FIGS. 7 through 9.

OPERATION

To insert the roll of tape 31 into the dispenser 10, the operator removes the keeper 29 from the roll support 28, places the roll on the holder and then replaces the keeper 29. The run of tape 35 is unrolled for a few inches and pushed into the inlet opening 44 until the free end thereof passes over the slots 119. The handle 62 of the self-threading means 61 is rotated to feed completely the free end of tape through the clearance space 123 between the shield or lip 124 and the lower wall 20 and across the gap 122 to leave the hopper through the outlet opening 48, margins of the tape being restrained by the edge guides. The tape passes between the lowermost portions 80 and 81 of the discs 68 and 69 and the free end of the tape projects beyond the outer edge 91 of the platform. The self-threading means is then disengaged, ie the handle is positioned so that the spikes are clear of the clearance slots, thus permitting free movement of the tape when pulled. The device can be hung at the operator's side by the belt 24 at this stage, or earlier or later as described. The hopper is filled with adhesive and the lever 58 of the flow control gate means is positioned so as to produce a sufficient depth of adhesive on the tape as it leaves the outlet opening when pulled by the free end.

ALTERNATIVES AND EQUIVALENTS

FIGS. 7 THROUGH 9

Referring to FIGS. 8 and 9, portions of an alternative tape and adhesive dispenser 137 are shown, much of the dispenser being generally similar to the dispenser 10 of FIGS. 1 and 2. The dispenser 137 has an alternative self-threading means 138, and a hopper 140 having an end wall 141 and a lower wall 142. The hopper has a gap 144 at a lower edge of the end wall 141 controlled by a gate member 145 slidable in a pair of opposed gate guides, one guide 147 only being shown, the gap providing an outlet opening 148 of the hopper. An outfeed platform 150 extends from the outlet opening 148 and has a tape restrainer, not shown, similar to that of FIG. 1. The lower wall 142 has first and second portions 151 and 152 inclined to each other at an obtuse angle 154, a forward portion of the second portion 152 extending forwardly as a shield or lip 156 over a rear portion 157 of the first portion 151. The portion 156 thus extends from a lower portion of the hopper and is spaced from the portion 152 to define clearance space 160 which provides an inlet opening 161 for the hopper equivalent to the inlet opening 44 of the tape dispenser 10. The rear portion 157 is curved downwardly to provide a relatively wide funnel-like entrance to the inlet opening 161 to facilitate insertion of tape as will be described. An edge guide 162 and an opposed edge guide (not shown) extend from a forward portion of the shield to the outlet opening 148 and are aligned with a similar edge guide 163 on the outfeed platform.

Referring to FIG. 7, the self-threading means 138 further includes a relatively stiff sheet finger member 165 which is generally rectangular in plan having a length 167 greater than spacing between inlet and outlet openings and a width 168 less than spacing between the edge guide 162 and the opposed edge guide (not shown). The member 165 is used only when threading the tape and, to avoid loss, is kept with the dispenser when not in use. The member 165 has a forward end 169 and a handle 170 which has an opening 171 for attachment to a convenient complementary peg member (not shown) adjacent a wall of the hopper. Thus the finger member can be inserted through the inlet opening 161 and pushed along and adjacent the first portion 151 of the wall to pass through the outlet opening 148 onto the outfeed platform 150.

Referring to FIG. 8, in operation the run of tape 35 in unwound from the roll of tape (not shown) and folded about the end 169 of the finger member 165 to produce a fold or nip 173 in the tape as shown. Sufficient length of tape is used to prevent slippage of the tape around the end 169 which is blunt to reduce chances of the end cutting the tape. The finger enclosed by the tape is inserted in the inlet opening and is pushed in direction of an arrow 174 so as to draw the run of tape through the inlet opening, along the lower wall 142 of the hopper and outwards through the outlet opening. Preferably the tape and finger protrude beyond a forward edge of the outfeed platform (not shown) so that, when the finger member is withdrawn backwards through the dispenser, the fold of tape remains permitting the operator to grasp the fold or nip of tape to draw the run of tape through the hopper. As previously stated, the forward end 169 of the finger member has no sharp corners to reduce a risk of tearing of the tape, and also the finger is sufficiently thin to pass through the gap 144 when sandwiched between the tape. It may be necessary to raise the gate member 145 to increase size of the outlet opening 148. Clearly the space 160 is sufficiently wide to permit insertion of the finger member when sandwiched between the tape, and yet not so wide as to permit excessive amounts of adhesive to pass outwards through the inlet opening.

When the hopper 140 contains adhesive it is possible to thread an end of the tape through the dispenser by using the finger member. This is one of the major advantages of the alternative threading means 138. Additional advantages of the means 138 relate to the elimination of the clearance slot pairs 119 and 125 in the portion 39 and shield 124 which reduces chances of dripping, and that the means 138 is simple to use and easy to manufacture. Preferably the dispenser has a retaining means to hold the finger member 165 when not required for threading so as to reduce chances of loss of the finger member.

I claim:

1. A tape adhesive dispenser having a hopper to contain adhesive, the hopper having tape inlet and outlet openings generally adjacent a lower wall of the hopper, and roll supporting means to carry a roll of tape, a run of tape being adapted to pass between the openings and along an upper surface of the lower wall so as to be exposed to adhesive in the hopper, so that adhesive is carried on the tape as the tape passes outwards from the hopper to the outlet opening, the dispenser being further characterized by outfeed guide means including:

i. an outfeed platform extending outwards from the outlet opening and having spaced edge guide means to sandwich opposite edges of the tape between an upper surface of the platform and the guide means as the tape passes along the upper surface of the platform, each edge guide means being an overhanging strip extending substantially along an edge of the platform, the strips having inner edges spaced apart at outer ends thereof to provide clearance therebetween, ii. a pair of relatively thin, parallel, spaced discs mounted for rotation above the platform within planes aligned with direction of feed of tape along the platform so that lowermost portions of the rims of the discs are spaced closely from the platform and within the clearance between the outer ends of the edge guide means to permit the tape to pass between the discs and the platform whilst maintaining the tape generally adjacent the platform, the discs being spaced apart from each other adjacent to an area of contact with the tape so that adhesive is retained on the tape as it passes beneath the tape restrainer, and spaced inwardly of the inner edges of the strips to restrain the tape adjacent the central portion thereof.

2. A dispenser as claimed in claim 1 further including:

i. flow control gate means cooperating with the outlet opening so as to control thickness of adhesive carried on the tape as it leaves the outlet opening.

3. A dispenser as claimed in claim 2 in which the flow control gate means includes:

i. a pair of spaced gate guides provided on a wall of the hopper adjacent the outlet opening, ii. a gate member slidably mounted in the gate guides for movement generally normal to the upper surface of the platform, the gate member having a straight lower edge generally parallel with and spaced from the upper surface of the platform to define a gap therebetween, iii. a lever hinged to rotate relative to the hopper and cooperating with the gate member so that swinging of the lever varies the gap between the lower edge of the gate member and the platform, iv. locking means to hold the gate in desired position to maintain a desired gap.

4. A dispenser as claimed in claim 1 further including:

i. a self-threading means cooperating with the tape to feed a free end of the tape through the outlet opening, the self-threading means being retractable to permit free passage of the tape from the dispenser with no restriction from the self-threading means.

5. A dispenser as claimed in claim 4 in which the self-threading means includes:

i. the lower wall of the hopper having clearance means, ii. feed means mounted below the lower wall of the hopper and positioned so as to project through the clearance means to engage the tape when in an extended position for feeding the tape, and to be clear of the tape in a retracted position to permit the tape to be fed freely from the dispenser, iii. a shield extending from a lower portion of the hopper generally adjacent to the inlet opening and spaced sufficiently above the clearance means in the lower wall of the hopper to define a clearance space between the shield and the lower wall to accept the tape therebetween, and simultaneously essentially to prevent flow of adhesive between the shield and the lower wall.

6. A dispenser as claimed in claim 5 in which:

i. the clearance means in the lower wall of the hopper include a plurality of clearance slots aligned in direction of feed of the tape, ii. the shield has similar clearance slots positioned generally above and aligned with the clearance slots in the lower wall of the hopper, iii. the feed means includes a spiked member having a plurality of spikes disposed so that in the extended portion thereof, some spikes project through the clearance slots in the lower wall of the hopper and the shield so that actuation of the self-threading means causes the spikes projecting through the clearance slots to engage the tape and to move it towards the outlet opening, and in the retracted position the spikes are clear of the clearance slots to permit free passage of the tape.

7. A dispenser as claimed in claim 6 in which the spiked member is characterized by:

i. a core member journalled for rotation about an axis disposed transversely to direction of feed of the tape, the core member having a periphery, the spikes extending from a portion of the periphery so that a remaining portion of the periphery is without spikes, the spikes and the core member being positioned so that when the self-threading means is actuated, the spikes project through the clearance slots to engage and feed the tape, and when the feed means is disengaged the core member is positioned so that the spikes are retracted from the slots and a smooth portion of the periphery without spikes is adjacent the slots to permit free passage of the tape through the self-threading means.

8. A dispenser as claimed in claim 4 in which the self-threading means includes:

i. a shield extending from a lower portion of the hopper generally adjacent to the inlet opening and spaced above the lower wall of the hopper to define a clearance space therebetween serving as the inlet opening, ii. a relatively stiff sheet finger member being sufficiently thin to pass through the clearance space between the shield and the lower wall when sandwiched between portions of tape and also to pass through the outlet opening, the finger member having a blunt forward end, to permit threading of tape into the dispenser by drawing with the finger member a fold of tape through the inlet opening, across a lower wall of the hopper, and outwards through the outlet opening.

9. A dispenser as claimed in claim 1 in which:

i. the hopper has an inner side wall having an outer face, ii. the outer face of the inner side wall has belt attachment means for accepting a supporting belt, so that the dispenser can be hung adjacent the waist of an operator with the innerside wall thereof against the operator's thigh.

10. A tape and adhesive dispenser having a hopper to contain adhesive, the hopper having tape inlet and outlet openings generally adjacent a lower wall of the hopper, and roll supporting means to carry a roll of tape, a run of tape being adapted to pass between the openings and along an upper surface of the lower wall so as to be exposed to adhesive in the hopper, so that adhesive is carried on the tape as the tape passes outwards from the hopper through the outlet opening; the dispenser being further characterized by outfeed guide means including:

i. an outfeed platform extending outwards from the outlet opening and having spaced edge guide means to guide opposite edges of the tape as the tape passes along an upper surface of the platform, ii. a tape restrainer mounted for rotation in direction of the feed of the tape above the platform so that a lowermost portion thereof is spaced closely from the upper surface of the platform and the restrainer, the restrainer having clearance adjacent to an area of contact with the tape so that adhesive is retained on the tape as it passes beneath the tape restrainer, the dispenser further including a self-threading means cooperating with the tape to feed a free end of the tape through the outlet opening, the self-threading means being characterized by:

iii. the lower wall of the hopper having clearance means, iv. feed means mounted below the lower wall of the hopper and positioned so as to project through the clearance means to engage the tape when in an extended position for feeding the tape, and to be clear of the tape in a retracted position to permit the tape to be fed freely from the dispenser, v. a shield extending from a lower portion of the hopper generally adjacent to the inlet opening and spaced sufficiently above the clearance means in the lower wall of the hopper to define a clearance space between the shield and the lower wall to accept the tape therebetween, and simultaneously essentially to prevent flow of adhesive between the shield and the lower wall.

11. A dispenser as claimed in claim 10 in which:

i. the clearance means in the lower wall of the hopper include a plurality of clearance slots aligned in direction of feed of the tape, ii. the shield has similar clearance slots positioned generally above and aligned with the clearance slots in the lower wall of the hopper, iii. the feed means includes a spiked member having a plurality of spikes disposed so that in the extended portion thereof, some spikes project through the clearance slots in the lower wall of the hopper and the shield so that actuation of the self-threading means causes the spikes projecting through the clearance slots to engage the tape and to move it towards the outlet opening, and in the retracted position the spikes are clear of the clearance slots to permit free passage of the tape.

12. A tape and adhesive dispenser having a hopper to contain adhesive, the hopper having tape inlet and outlet openings generally adjacent a lower wall of the hopper, and roll supporting means to carry a roll of tape, a run of of tape being adapted to pass between the openings and along an upper surface of the lower wall so as to be exposed to adhesive in the hopper, so that adhesive is carried on the tape as the tape passes outwards from the hopper through the outlet opening; the dispenser being further characterized by outfeed guide means including:

i. an outfeed platform extending outwards from the outlet opening and having spaced edge guide means to guide opposite edges of the tape as the tape passes along an upper surface of the platform, ii. a tape restrainer mounted for rotation in direction of the feed of the tape above the platform so that a lowermost portion thereof is spaced closely from the upper surface of the platform to permit the tape to pass between the platform and the restrainer, the restrainer having clearance adjacent to an area of contact with the tape so that adhesive is retained on the tape as it passes beneath the tape restrainer, the dispenser further including a self-threading means cooperating with the tape to feed a free end of the tape through the outlet opening, the self-threading means being characterized by:

iii. a shield extending from a lower portion of the hopper generally adjacent to the inlet opening and spaced above the lower wall of the hopper to define a clearance space therebetween serving as the inlet opening, iv. a relatively stiff sheet finger member being sufficiently thin to pass through the clearance space between the shield and the lower wall when sandwiched between portions of tape and also to pass through the outlet opening, the finger member having a blunt forward end, to permit threading of tape into the dispenser by drawing with the finger member a fold of tape through the inlet opening, across a lower wall of the hopper, and outwards through the outlet opening.

* * * * *